US005442895A

United States Patent [19]

Linson

[11] Patent Number: 5,442,895

[45] Date of Patent: Aug. 22, 1995

[54] METHOD AND APPARATUS FOR UNWRAPPING A WRAPPED ARTICLE

[75] Inventor: Richard L. Linson, Long Beach, Calif.

[73] Assignee: Scope Industries, Santa Monica, Calif.

[21] Appl. No.: 224,870

[22] Filed: Apr. 29, 1994

[51] Int. Cl.[6] ..... B65B 43/26; B02C 23/02

[52] U.S. Cl. ..... 53/381.2; 53/384.1; 53/492; 414/412

[58] Field of Search ..... 414/412, 417; 53/381.2, 53/381.3, 381.5, 384.1, 492

[56] References Cited

U.S. PATENT DOCUMENTS

| | | | |
|---|---|---|---|
| 3,889,442 | 6/1975 | Grahn et al. | 53/381.2 |
| 4,504,183 | 3/1985 | Bennison et al. | 53/381.2 |
| 4,798,508 | 1/1989 | Lewis | 53/381.2 |
| 4,929,141 | 5/1990 | Keesey et al. | 53/381.2 |
| 5,282,713 | 2/1994 | Lande | 414/412 |

*Primary Examiner*—W. Donald Bray
*Attorney, Agent, or Firm*—Benman, Collins & Sawyer

[57] ABSTRACT

An apparatus and method for unwrapping an article (e.g., bread) wrapped in a package having a first end and a second end. The inventive apparatus includes a first mechanism for holding the first end of the package, a second mechanism for at least partially opening the second end of the package, and a third mechanism for removing the article from the package. In a specific implementation, package is supported on a conveyor, the retaining clip on the package is engaged by a guide and the package is moved into contact with a blade which cuts substantially through the package. The package is held by the guide while the article falls from the package due to the effect of gravity.

13 Claims, 3 Drawing Sheets

METHOD AND APPARATUS FOR UNWRAPPING A WRAPPED ARTICLE

BACKGROUND OF THE INVENTION

1. Field of the Invention:

The present invention relates to methods and apparatus used in the food industry. Specifically, the present invention relates to methods and apparatus for removing bread and other products from wrappings in which these products are packaged.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

1. Description of the Related Art:

High grade edible bread crumbs are typically made from loaves of bread which were packaged in plastic or cellophane wrappers for sale in grocery stores. The bread is unwrapped and removed from the wrapping. Next, the bread is dried and milled.

In conventional bread crumb facilities, the loaves of bread are unwrapped by hand. Unfortunately, modern, highly efficient, high speed bread crumb facilities such as that owned and operated by the present assignee, Topnotch Foods, Inc. of Santa Monica, Calif., can process up to 10,000 pounds of bread crumbs per hour. With one loaf of bread weighing approximately one pound this equates with a requirement to unwrap 10,000 loaves of bread per hour. With each employee being able to unwrap on the order of 100 loaves per hour, 100 employees would be needed to unwrap prepackaged bread to keep pace with the capacity of the facility.

As the labor costs associated with the unwrapping of large quantities of bread are substantial, a need has been recognized in the art for a technique for unwrapping prepackaged bread at a high speed.

SUMMARY OF THE INVENTION

The need in the art is addressed by the present invention which provides an apparatus and method for unwrapping an article (e.g., bread) wrapped in a package having a first end and a second end. The inventive apparatus includes a first mechanism for holding the first end of the package, a second mechanism for at least partially opening the second end of the package, and a third mechanism for removing the article from the package.

In a specific implementation, package is supported on a conveyor, the retaining clip on the package is engaged and the package is moved into contact with a blade which cuts substantially through the package. The package is held by the clip while the article falls from the package due to the effect of gravity.

DESCRIPTION OF THE INVENTION

Illustrative embodiments and exemplary applications will now be described with reference to the accompanying drawings to disclose the advantageous teachings of the present invention.

Figure 1:
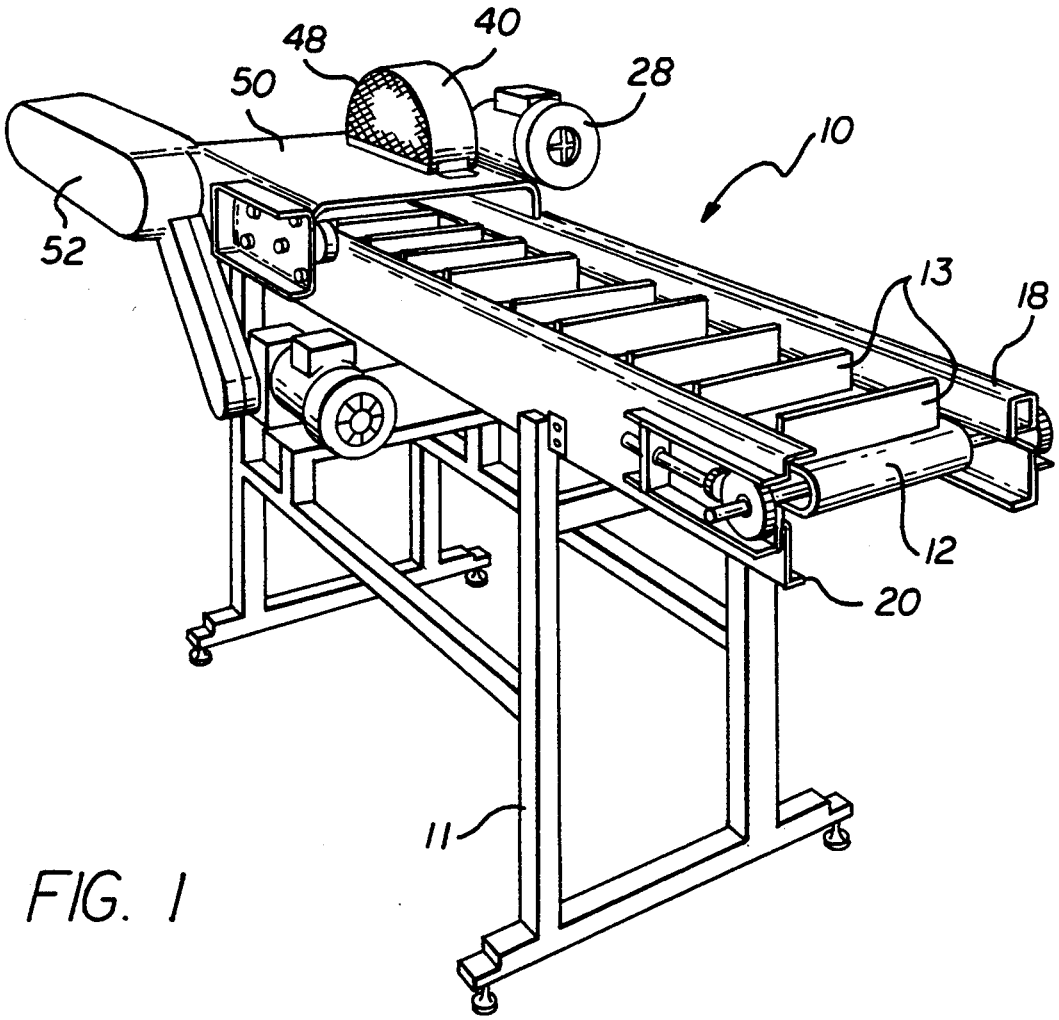
FIG. 1 is a left-front perspective view of an illustrative embodiment of the apparatus for unwrapping a wrapped article of the present invention.
Figure 2:
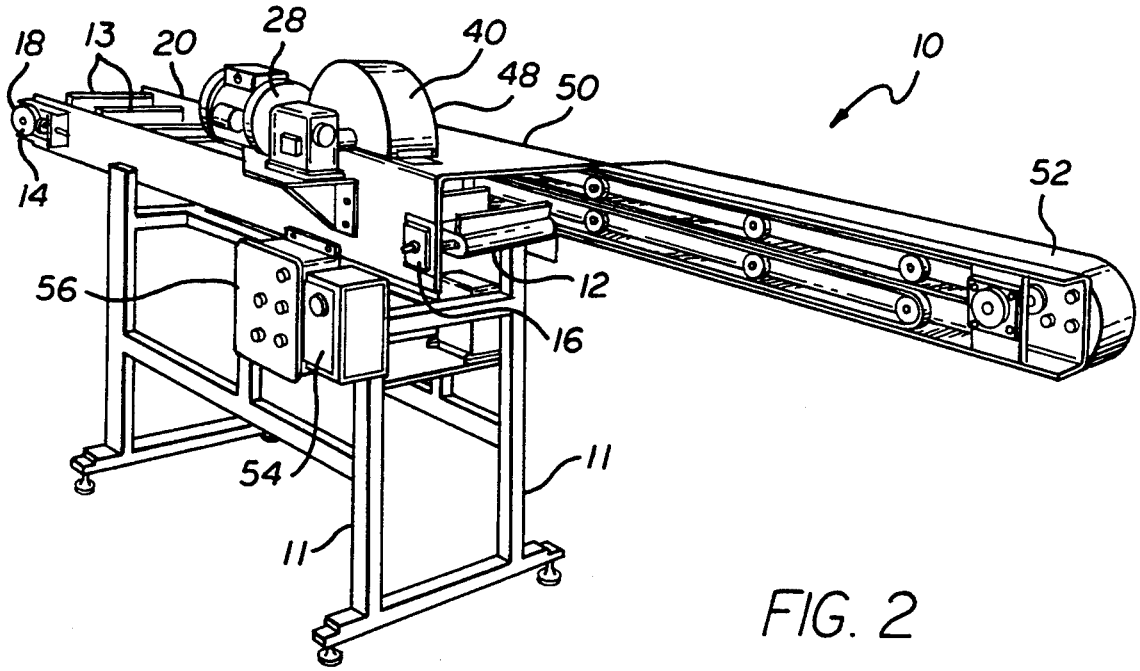
FIG. 2 is a left-rear perspective view of an illustrative embodiment of the apparatus for unwrapping a wrapped article of the present invention.

FIG. 1 is a left-front perspective view of an illustrative embodiment of the apparatus for unwrapping a wrapped article of the present invention. FIG. 2 is a left-rear perspective view of an illustrative embodiment of the apparatus for unwrapping a wrapped article of the present invention. The machine 10 is mounted on a frame 11. As illustrated in FIG. 1, the machine 10 includes an elongate cleated conveyor belt 12 of conventional design and construction. The belt 12 has a plurality of cleats 13. The cleated belt 12 is mounted on first and second rollers 14 and 16 situated between first and second rails members 18 and 20. The cleated conveyor belt 12 is adapted to support loaves of bread 22 or other articles wrapped in plastic or cellophane containers 24 having a plastic clip 26 on the open end thereof. The cleated conveyor belt 12 is driven by a first motor 28 with an associated pulley 30.

Figure 3:
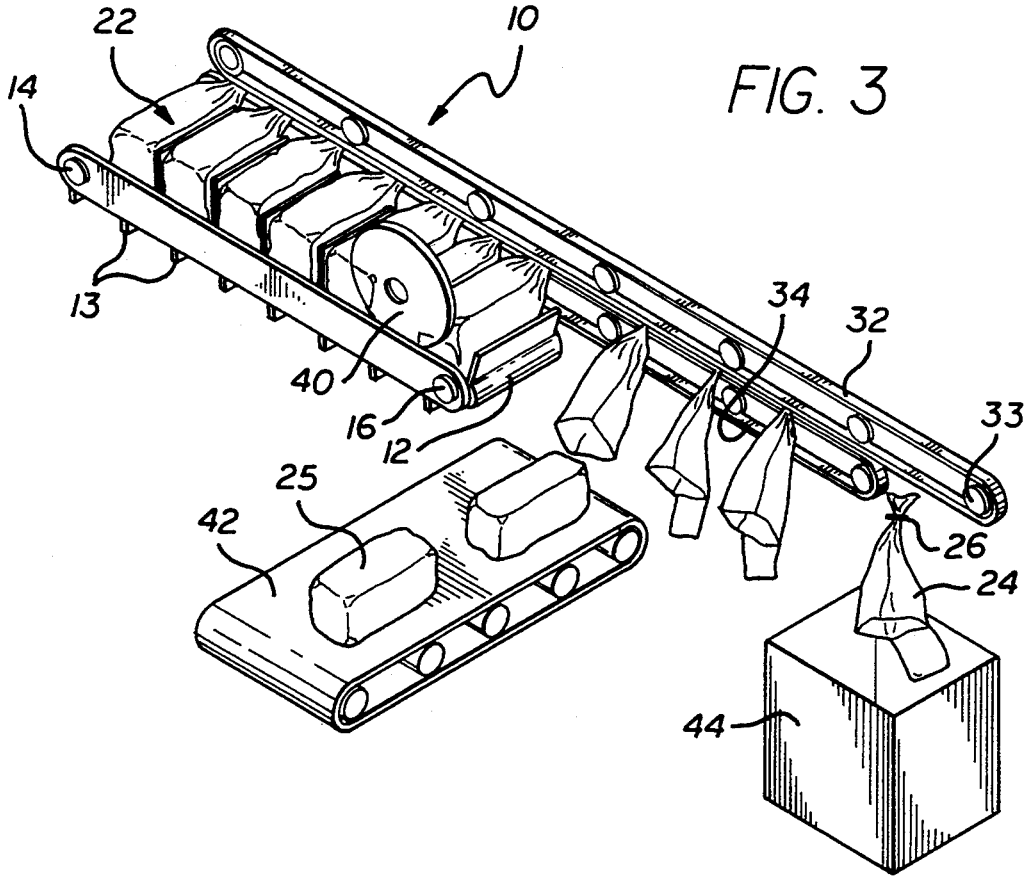
FIG. 3 is a simplified left-rear perspective view of the apparatus for unwrapping a wrapped article of the present invention.

FIG. 3 is a simplified left-rear perspective view of the apparatus for unwrapping a wrapped article of the present invention. As illustrated in FIG. 3, the cleated conveyor belt 12 moves each package 22 into contact with upper and lower package retaining belts 32 and 34. The upper and lower package retaining belts 32 and 34 are of conventional design and construction.

Figure 4:
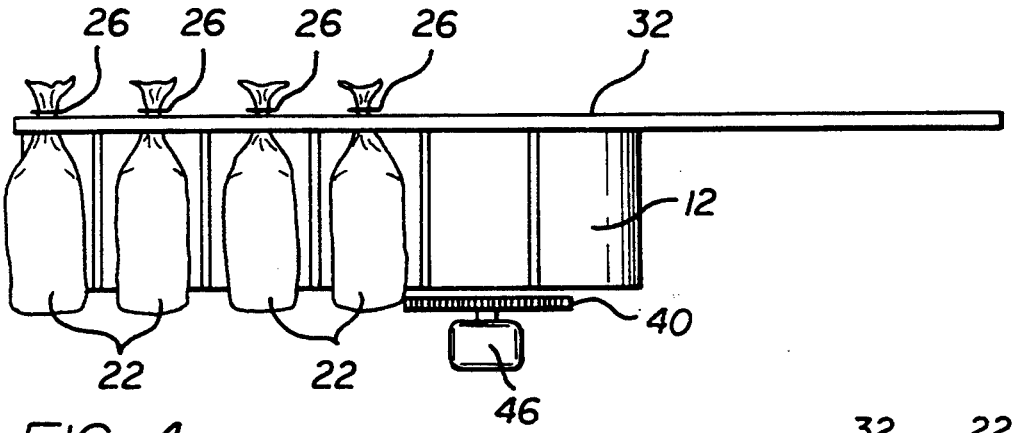
FIG. 4 is a top view of a further simplified diagram of the apparatus for unwrapping a wrapped article of the present invention.

FIG. 4 is a top view of a further simplified diagram of the apparatus for unwrapping a wrapped article of the present invention.

Figure 5:
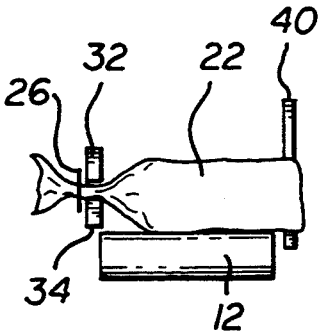
FIG. 5 a simplified end view of the apparatus for unwrapping a wrapped article of the present invention.

FIG. 5 a simplified end view of the apparatus for unwrapping a wrapped article of the present invention. As illustrated in FIG. 5, the upper and lower package retaining belts 32 and 34 are mounted in a vertical, parallel, stacked arrangement with a small gap 33 therebetween to retain the clip of each package of bread. In the alternative, two guide rails or a vacuum suction arrangement may be used to retain one end of each package.

Figure 6:
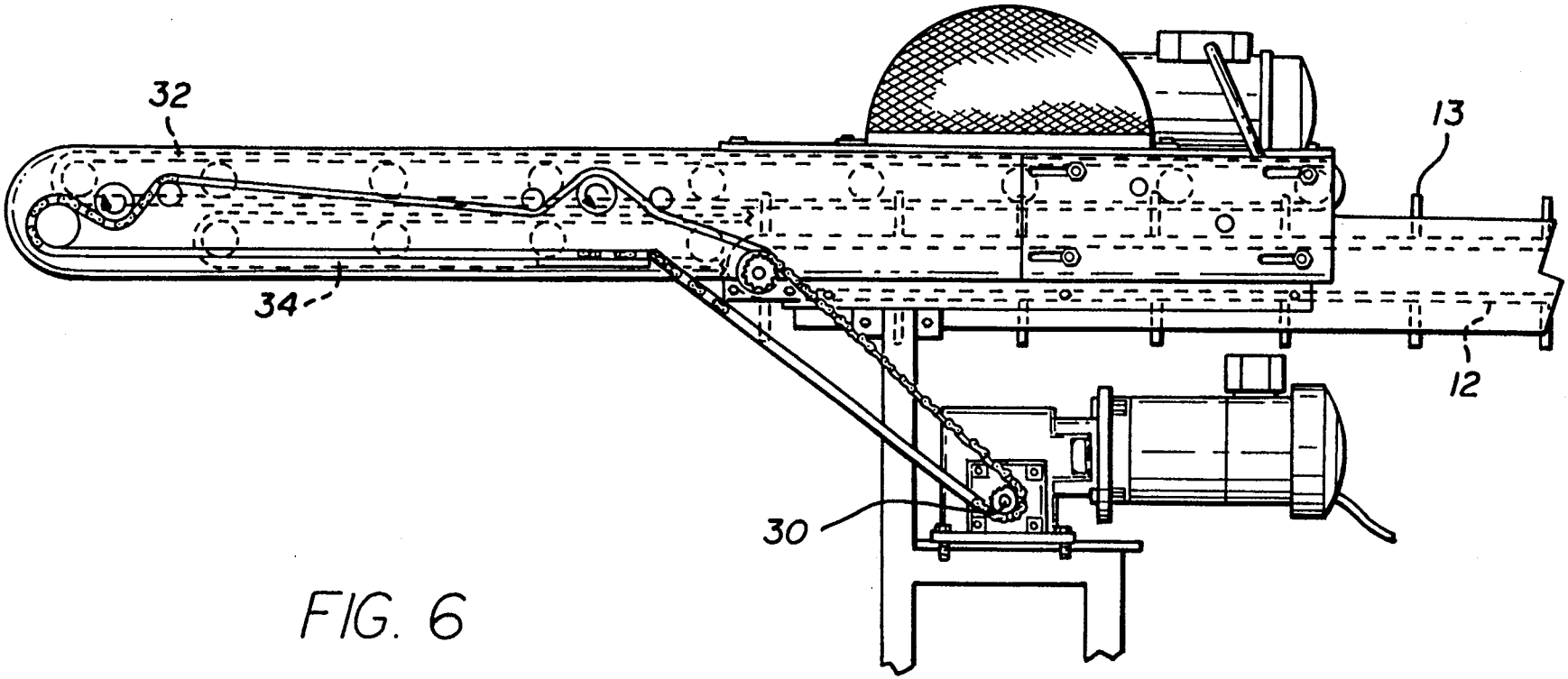
FIG. 6 illustrates an arrangement by which the cleated conveyor belt and first and second package retaining belts are driven by a first motor and associated pulley arrangement.

As illustrated in the simplified view of FIG. 6, the cleated conveyor belt 12 and the upper and lower package retaining belts 32 and 34 are driven by the first motor 28 with the associated pulley 30. In the preferred embodiment, the belts may be driven at a high speed or a low speed.

As illustrated in FIG. 3, the movement of the belts 12, 32 and 34 causes the closed ends of the loaves of bread 22 to engage a motor driven stainless steel blade 40. The blade 40 cuts substantially, but not completely, through the packaging of each loaf. The upper and lower package retaining belts 32 and 34 extend beyond the end of the cleated conveyor belt 12. As a result, the package 22 is retained by the upper and lower package retaining belts 32 and 34 on one end while the cut end thereof falls due to the effect of gravity. The bread 25 falls through the open end of the package 22 onto an auxiliary conveyor 42. The empty containers 24 are deposited into a bin 44 at the end of the lower package retaining belt 34.

Returning to FIGS. 1 and 2, the blade 40 is driven by a one to two horsepower off-the-shelf motor 46 at substantially constant speed. A first circular cover guard 48 is provided over the blade 40. A planar cover 50 is provided over the cleated conveyor 12 at the blade 40. In addition, a guard 52 is provided over the upper and lower package retaining belts 32 and 34. Electrical switches 54 and 56 are mounted on the frame 11 to turn on motors and to control the speed of the pulleys.

The present invention has been described herein with reference to a particular embodiment for a particular application. Those having ordinary skill in the art and access to the present teachings will recognize additional modifications applications and embodiments within the scope thereof.

It is therefore intended by the appended claims to cover any and all such applications, modifications and embodiments within the scope of the present invention.

Accordingly,

What is claimed is:

1. Apparatus for unwrapping an article wrapped in a package, said package having a first end and a second end, said apparatus comprising:

first means for holding the first end of the package;

second means for at least partially opening the second end of the package; and third means for removing the package from the article.

2. The invention of claim 1 further including means for supporting said package.

3. The invention of claim 2 further including means for moving said package into engagement with said second means.

4. The invention of claim 1 wherein said package has package retaining means at said first end thereof and said first means includes means for engaging said package retaining means.

5. The invention of claim 1 wherein said second means comprises means for cutting through said package.

6. The invention of claim 1 wherein said third means includes means for holding said first end of said package while said second end thereof is unsupported such that said article exits said package due to the effect of gravity.

7. Apparatus for unwrapping an article wrapped in a package, said package having a first end and a second end and a clip at said first end thereof, said apparatus comprising:

means for supporting said package and for moving said package;

first and second belts for holding the clip of the package therebetween; and cutting means for at least partially cutting open the second end of the package.

8. A method for unwrapping an article wrapped in a package, said package having a first end and a second end, said method including the steps of:

a) holding the first end of the package;

b) cutting through the second end of the package; and c) holding the package by the first end thereof such that the article exits the package under the effect of gravity.

9. Apparatus for unwrapping an article wrapped in a package, said package having a first end, a second end, and package retaining means at said first end thereof, said apparatus comprising:

first means for holding the first end of the package, said first means including means for engaging said package retaining means;

second means for at least partially opening the second end of the package; and third means for removing the package from the article.

10. The invention of claim 9 wherein said package retaining means is a clip and said means for engaging said package retaining means includes first and second guides.

11. The invention of claim 10 wherein said first and second guides are first and second belts respectively.

12. Apparatus for unwrapping an article wrapped in a package, said package having a first end and a second end, said apparatus comprising:

first means for holding the first end of the package;

second means for at least partially opening the second end of the package, said second means comprising means for cutting through said package; and third means for removing the package from the article.

13. Apparatus for unwrapping an article wrapped in a package, said package having a first end and a second end, said apparatus comprising:

first means for holding the first end of the package;

second means for at least partially opening the second end of the package, said second means comprising means for cutting through said package; and third means for removing the package from the article, said third means including means for holding said first end of said package while said second end thereof is unsupported such that said article exits said package due to the effect of gravity.

* * * * *